United States Patent [19]

Kusakawa

[11] Patent Number: 4,650,404

[45] Date of Patent: Mar. 17, 1987

[54] MOTOR-DRIVEN FUEL PUMP

[75] Inventor: Yukio Kusakawa, Anjo, Japan

[73] Assignee: Nippondenso Co., Ltd., Kariya, Japan

[21] Appl. No.: 716,585

[22] Filed: Mar. 27, 1985

[30] Foreign Application Priority Data

Apr. 5, 1984 [JP] Japan ..... 59-68698

[51] Int. Cl.[4] ..... F04B 17/00; F04D 5/00

[52] U.S. Cl. ..... 417/440; 415/93; 415/213 T; 251/148; 138/146

[58] Field of Search ..... 417/455, 440, 424; 415/53 T, 213 T; 138/46, 92, 94, 89; 251/148, 304

[56] References Cited

U.S. PATENT DOCUMENTS

| | | | |
|---|---|---|---|
| 108,579 | 10/1870 | Ford | 138/46 |
| 412,480 | 10/1889 | Davis | 417/440 |
| 1,265,070 | 5/1918 | Feyzes | 417/440 |
| 2,251,552 | 8/1941 | Purdy | 417/440 X |
| 2,404,996 | 7/1946 | Thrush | 251/148 |
| 2,640,497 | 6/1953 | Reeve | 251/148 |
| 2,927,601 | 3/1960 | Martin et al. | 251/148 |
| 3,677,516 | 7/1972 | Hicks | 251/304 X |
| 4,508,492 | 4/1985 | Kusakawa et al. | 417/366 |

FOREIGN PATENT DOCUMENTS 754064 2/1953 Fed. Rep. of Germany ..... 417/440

*Primary Examiner*—Carlton R. Croyle
*Assistant Examiner*—Theodore W. Olds
*Attorney, Agent, or Firm*—Cushman, Darby & Cushman

[57] ABSTRACT

A motor-driven regenerative type fuel pump is provided with an overflow mechanism disposed adjacent to a discharge pipe. The overflow mechanism includes a plug hole in a pump housing and a plug member disposed in the plug hole. The pump housing is formed with an axially inclined recess circumferentially extending around the plug member and communciated with an axial groove formed in the plug member. The rate of overflow of fuel and thus the upper limit of the pump discharge can be adjusted by rotating the plug member relative to the plug hole to compensate for any insufficiency of pressure regulating ability of a pressure regulator in an engine fuel injection system. The overflow mechanism further includes an adjustment-locking member attached to the pump housing and the plug member after the overflow-adjustment by the manufacture has been completed.

9 Claims, 14 Drawing Figures

MOTOR-DRIVEN FUEL PUMP

BACKGROUND OF THE INVENTION

1. Field of the Invention

The present invention relates to a motor-driven fuel pump for pumping fuel from a fuel tank through a pressure regulator and an injector into an internal combustion engine.

2. Description of the Prior Art

An engine fuel injection system has been known which includes a motor-driven fuel pump adapted to be disposed in a fuel tank so as to pump liquid fuel from the tank through a pressure regulator and a filter to an injector which is operative to inject the fuel into an engine. A typical prior art motor-driven fuel pump of the class specified has been desinged to provide a discharge pressure of more than 200 Kpa. The discharge requirement for the prior art fuel pump was solely to meet the lower limit of the discharge pressure. In designing the prior art fuel pump, the designer was not required to pay any particular attention to the upper limit of the pump discharge.

Recent automotive fuel injection systems manufactured by automobile manufacturers, however, need fuel pumps to be operated to provide discharge pressure of medimum levels around 100 Kpa. Because of this greatly lowered fuel pump discharge pressure, the pressure regulators of associated fuel injection systems are required to provide greatly increased pressure-regulating abilities so as to more strictly control the upper and lower limits of the pressure of fuel to be injected. However, pressure-regulators which satisfy this requirement are very difficult to manufacture and tend to be very expensive.

SUMMARY OF THE INVENTION

It is an object of the present invention to provide a motor-driven fuel pump which does not need a highly increased pressure-regulating ability of an asociated presure regulator but is operate itself to provide a controlled discharge pressure which falls within a predetermined desirable pressure range, i.e., a discharge pressure having an upper limit within the predetermined pressure range.

The motor-driven fuel pump according to the present invention is operated to pump liquid fuel from a fuel tank through a fuel line including a pressure-regulator and an injector into an internal combustion engine. The fuel pump includes an electric motor to be energized by an electric power source, such as batteries mounted on an associated automobile, a pump housing defining therein a pump chamber provided with fuel inlet and outlet, an impeller rotatively disposed in the pump chamber and drivingly connected to the motor to suck the fuel from the tank through the fuel inlet into the pump chamber and discharge the fuel through the outlet, means defining a fuel discharge passage extending in fluid-flow communication with the pump chamber outlet, a check valve disposed in the fuel discharge passage to prevent backward flow of the fuel toward the pump chamber outlet, and overflow means operative to allow a part of the fuel in the fuel discharge passage upstream of the check valve to overflow at a controlled rate.

The overflow means may preferably comprise a plug hole and a plug member therein. The plug member and the plug hole may preferably be so shaped and dimensioned as to define therebetween an overflow passage having a fluid-flow cross-sectional area which is determined by the position of the plug member relative to the plug hole. Accordingly, when the component parts of the motor-driven fuel pamp have been assembled into a unit, the pump may be experimentarily operated by the manufacturer to check the discharge characteristic of the pump. If the pump discharge thus checked is higher or lower than a predetermined desirable range, the position of the plug member relative to the plug hole can be adjusted by the pump manufacturer to adjust the rate of overflow of the fuel and thus the pump discharge. Preferably, the plug member is rotatable at that time relative to the plug hole to enable the plug member to be rotated by the manufacturer by means of a tool, such as a screw driver, to adjust the rotational position of the plug member relative to the plug hole.

The fuel pump may preferably be provided with an adjustment-locking member which is attached, after the adjustment of the overlfow, to the pump housing and to the plug member to threby prevent any further rotation of the plug member relative to the plug hole.

As the overflow means provided in the fuel pump according to the present invention can be adjusted by the manufacturer to assure that the pump provides a discharge characteristic having not only the lower dishcarge limit but also the upper discharge limit both falling within a pressure range which has been predetermined to avoid the necessity for a highly precise pressure-regulating ability of an expensive pressure regulator to be used with the fuel pump in a fuel injection system for an internal combustion engine.

The above and other objects, features and advantages of the present invention will be made more apparent by the following description with reference to the accompanying drawings.

DESCRIPTION OF A PREFERRED EMBODIMENT

Figure 1:
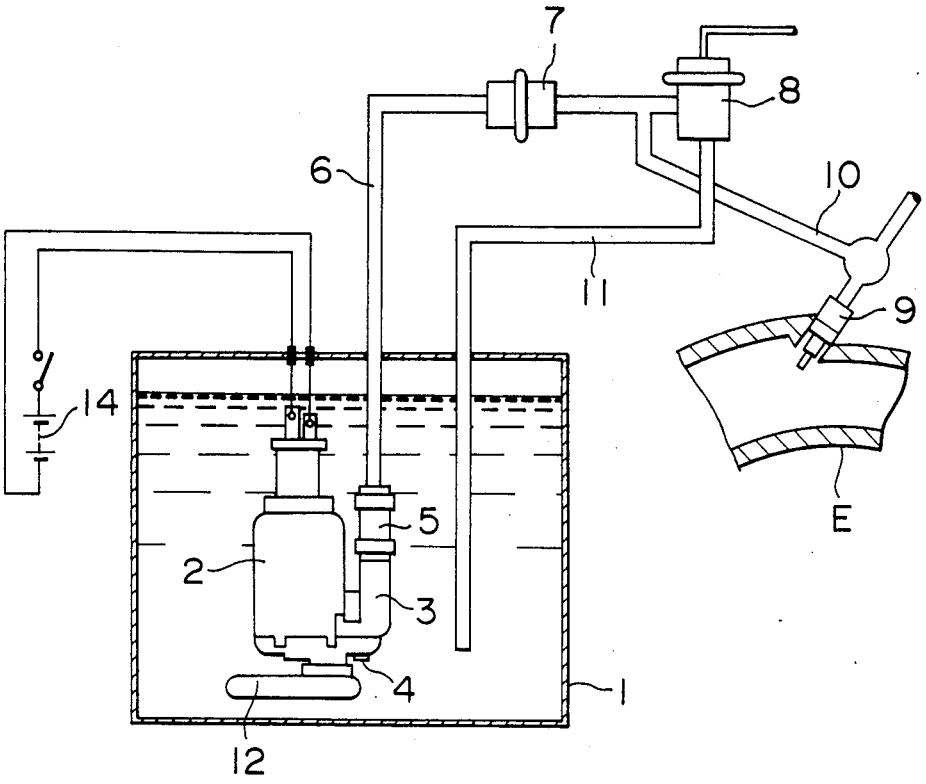
FIG. 1 is a diagrammatic illustration of a fuel injection system including an embodiment of the fuel pump according to the present invention.

Referring first to FIG. 1 of the drawings, a fuel injection system for an internal combustion engine E includes an embodiment of a motor-driven fuel pump 2 according to the present invention. The pump 2 is disposed in liquid fuel contained in a fuel tank 1 and includes a filter 12 disposed at an inlet section of the pump, a discharge pipe 3 and an overflow mechanism 4 to be described in detail later. The discharge pipe 3 is connected by a coupling member 5 to one end of a fuel conduit 6 the other end of which is connected to a fuel pressure regulator 8. A fuel filter 7 is disposed in the fuel line 6 upstream of the pressure regulator 8. A branch conduit 10 is connected at one end to the fuel line 6 between the filter 7 and the pressure regulator 8 and has the other end connected to a fuel injector 9 associated with an intake manifold of the engine E. A return pipe 11 extends between the pressure regulator 8 and the fuel tank 1. The fuel pump 2 is electrically connected to an electrical power source 14.

Figure 2:
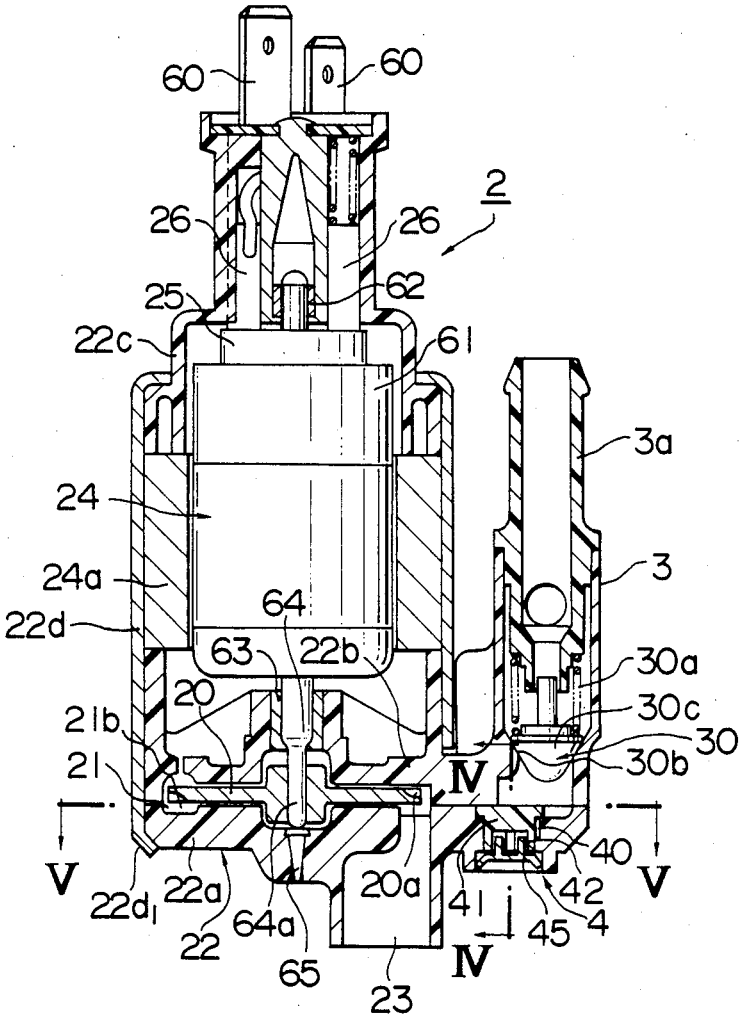
FIG. 2 is an enlarged axial sectional view of the fuel pump shown in FIG. 1.
Figure 3:
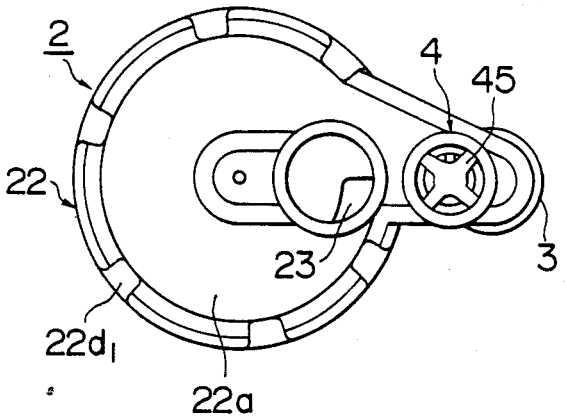
FIG. 3 is a bottom view of the fuel pump shown in FIG. 2.

Referring to FIGS. 2 and 3, the fuel pump 2 includes a regenerative type impeller 20 provided with two circumferential rows of vane grooves 20*a* formed in the end faces of the impeller along the circumferential edges of the end faces. The vane grooves 20*a* in one of the impeller end faces are circumferentially staggered relative to the vane grooves 20*a* in the other impeller end face.

The impeller 20 is rotatably disposed in a pump chamber 21 defined in a pump housing 22 which comprises an outer pump housing member 22*a* with an integral suction port 23, an inner pump housing member 22*b* disposed in abutment contact with the outer pump housing member 22*a* to cooperate therewith to define the pump chamber 21 therebetween, a motor brush housing 22*c* retaining a brush unit 26 in sliding contact with a commutator 25 of an electric motor 24, and a cylindrical metallic yoke housing 22*d* surrounding the peripheries of the outer and inner pump housing members 22*a* and 22*b* and a part of the periphery of the brush housing 22*c* to secure them into a unitary structure. For this purpose, the yoke housing 22*d* has a plurality of integral tabs $22d_1$ depending from the bottom end of the yoke housing and bent over the outer surface of the outer pump housing member 22*a*.

The motor 24 is a DC motor including permanent field magnets 24*a* disposed around a rotor 61 and held between the brush housing 22*c* and the inner pump housing member 22*b*. Electric terminals 60 are mounted on the brush housing 22*c* and electrically connected to the brush unit 26 and thus to the commutator 25 so that the rotor 61 can be rotated. The rotor 61 is supported by a rotor shaft 64 having an upper end rotatably supported by an upper bearing 62 fixed to the brush housing 22*c*, the lower end portion of the rotor shaft 64 being rotatably supported by a lower bearing 63 fixed to the inner pump housing member 22*b*. The lower end portion of the rotor shaft 64 has an extension 64*a*which is drivingly connected to the impeller 20 and extends therethrough into rotatable engagement with a thrust bearing 65 fixed to the outer pump housing member 22*a*.

Figure 4:
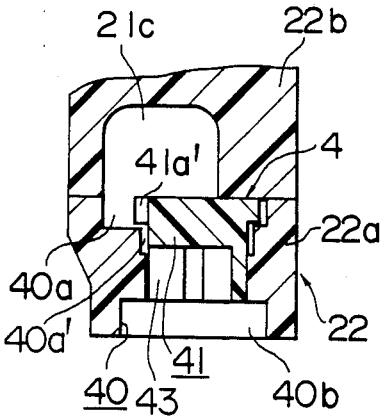
FIG. 4 is a fragmentary sectional view of the pump taken along line IV—IV in FIG. 2.
Figure 5:
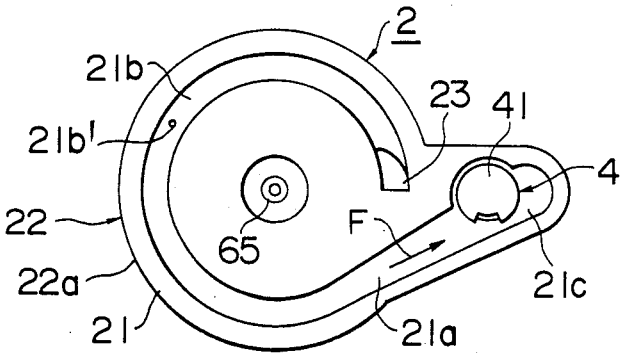
FIG. 5 is a plan view of a lower pump housing member as viewed from line V—V in FIG. 2.

Referring to FIGS. 2 to 6, a circumferential fluid passage 21*b* is defined between the grooved outer peripheral region of the bottom end face of the impeller 20 and the axially opposed region of the outer pump housing member 22*a*, as best shown in FIG. 5. A similar circumferential fluid passage (not shown) is defined between the upper end face of the impeller 20 and the inner pump housing member 22*b*. When the impeller 20 is rotated by the motor 24, the fuel is sucked from the fuel tank 1 through the suction port 23 moved through the fluid passages 21*b* in counterclockwise direction as viewed in FIG. 5 while the fuel pressure is progressively increased until the pressurized fuel flows through an outlet 21*a* of the pump chamber 21, as indicated by an arrow F in FIG. 5. The outer pump housing member 22*a* is formed therein with an aperture 21*b*′ communicating the fuel passage 21*b* with the interior of the tank 1 to facilitate removal of air bubbles contained in the fuel being pressurized.

The outlet 21*a* is divergent toward its downstream end 21*c* as shown in FIG. 5. The above-mentioned discharge pipe 3 is integral with the inner pump housing member 22*b* and has a lower end open to the diverged downstream end of the outlet 21*a* of the fuel passage 21*b*. A tubular tip 3*a* is sealingly fixed to the upper end of the discharge pipe 3. A check valve 30 is disposed within the discharge pipe 3 and comprises a generally conical valve member 30*c* and a compression coil spring 30*a* extending between the inner end of the tubular tip 3*a* and the valve member 30*c* to downwardly urge the same into sealing engagement with an annular valve seat 30*b* formed in the inner pump housing member 22*b* (see FIG. 2). The valve 30 is adapted to be normally opened by the fuel pressure in the outlet during operation of the fuel pump 2.

The above-mentioned overflow mechanism 4 is provided in the outer pump housing member 22*a* adjacent to the diverged downstream end portion 21*c* of the fuel outlet 21*a* to permit excess fuel to be returned therefrom back into the fuel tank 1. For this purpose, the overflow mechanism 4 includes a plug hole 40 formed in the outer pump housing member 22*a* and communicated with the diverged downstream end portion 21*c* of the fuel outlet 21*a* and a plug member 41 inserted into the plug hole 40, as best seen in FIG. 4. The plug member 41 has an enlarged top with which the bottom face of the inner pump housing member 22*b* is in abutment engagement to retain the plug member 41 against removal from the plug hole 40, as best shown in FIG. 4.

The overflow mechanism 4 will be described in more detail hereunder with reference to FIGS. 4 to 9. The plug hole 40 includes a larger upper end section 40*a* communicated with the diverged end portion 21*c* of the fuel outlet 21*a*, a larger lower end section 40*b* open in the underside of the outer pump housing member 22*a* and a substantially cylindrical intermediate section 40*c* interconnecting the upper and lower end sections 40*a* and 40*b*, as best seen in FIG. 7A. In the inner cylindrical peripheral surface of the intermediate section 40*c*, there is formed a recess or groove 40*a*′ which extends circumferentially of the plug hole 40, has its top open to the larger upper end section 40*a* of the hole 40 and has a bottom 46 which extends obliquely relative to the axis of the hole 40, as best seen in FIG. 7A.

Figure 6:
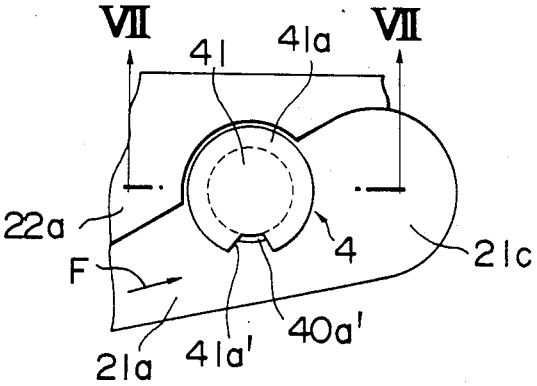
FIG. 6 is an enlarged fragmentary plan view of the lower pump housing member showing a discharge end portion of a fuel discharge passage and a fuel overflow mechanism disposed therein.
Figure 9:
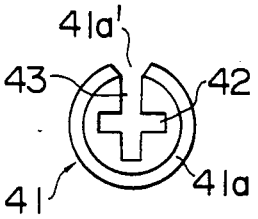
FIG. 9 is a bottom view of the plug.
Figure 10:
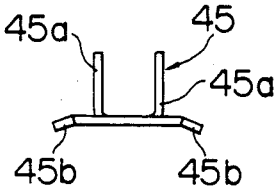
FIG. 10 is a side elevational view of a plug adjustment-locking member.
Figure 11:
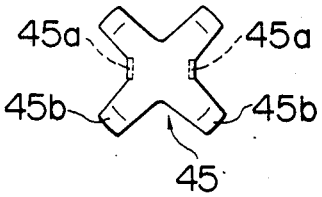
FIG. 11 is a bottom view of the adjustment-locking member.

The plug member 41 includes a generally C-shaped flange 41*a* extending around a part of the periphery of the top portion of a cylindrical main section 41*b* and having circumferentially opposed circumferential ends which define an opening or notch 41*a*′ therebetween, as best seen in FIGS. 6 and 9. An elongated axial groove 43 is formed in the outer peripheral surface of the cylindrical section 41*b* and is disposed in axial alignment with but axially spaced from the notch 41*a*′ in the flange 41*a*. The top face of the plug member 41 is planar so as to be abutted by the inner pump housing member 22*b* as shown in FIG. 4, but the bottom face of the plug member 41 is formed therein with a cross-shaped, tool-engagement recess 42 (see FIG. 9) which is substantially axially co-extensive with the elongated groove 43 (see FIG. 9) and communicated therewith (see FIG. 9).

Figure 7:
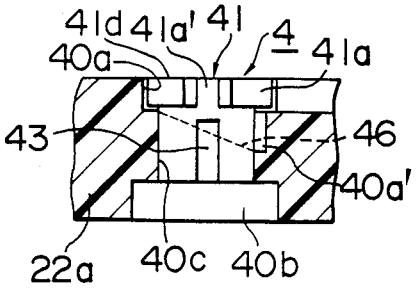
FIG. 7 is a sectional view of the overflow mechanism taken along line VII—VII in FIG. 6.
Figure 7A:
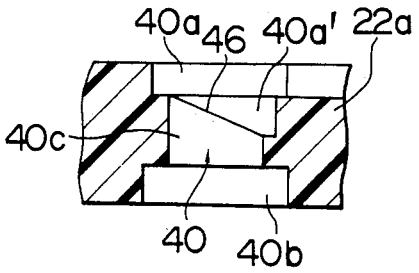
FIG. 7A is a view similar to FIG. 7 but illustrates a plug hole with a plug removed therefrom.
Figure 8:
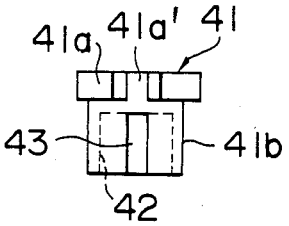
FIG. 8 is a side elevational view of the plug.

The plug hole 40 and the plug member 41 are arranged such that the flange 41*a* is loosely received in the larger upper section 40*a* while the cylindrical section 41*b* is snugly received in the cylindrical intermediate section 40*c* of the plug hole 40 with the outer peripheral surface of the cylindrical section 41*b* being in sealing engagement with but slidable relative to the cylindrical section 40*c* of the plug hole 40, as will be seen in FIG. 7. In addition, the upper part of the elongated axial groove 43 in the plug member 41 can be brought into overlapping relationship to the axially inclined circumferential groove 40*a'* formed in the inner peripheral surface of the plug hole 40, as will be seen in FIG. 7. It will be appreciated that the area of the axial groove 43 which is overlapped with the inclined groove 40*a'* is variable depending upon the rotational position of the plug member 41 relative to the plug hole 40. The notch 41*a'* in the flange 41*a* is operative to communicate the diverged end 21*c* of the fuel outlet 21*a* of the pump chamber 21 with the axially inclined circumferential groove 40*a'*. Accordingly, the rate of overflow of the fuel from the fuel outlet 21*a* through the overflow mechanism 4 back into the fuel tank 1 can be adjusted by rotating the plug member 41 relative to the plug hole 40 by means of a tool such as a screw driver (not shown) which is engageable with the tool-engagement groove 42 in the plug member 41. If the plug member 41 is rotated to a positoin in which the axial groove 43 in the plug member is not overlapped with the axially inclined circumferential groove 40*a'* in the outer pump housing member 22*a*, the fuel cannot overflow through the overflow mechanism 4.

The steps of assembling the component parts of the fuel pump 2 except for the plug member 41 are well known in the art and it will be sufficient to make it clear that the plug member 41 is fitted into the plug hole 40 before the outer and inner pump housing members 22*a* and 22*b* are assembled together. After all of the component parts of the fuel pump 2 described above have been assembled into a semi-finished pump unit, the unit is subjected to a test with respect to the discharge characteristic thereof. More specifically, the pump unit is experimentarily operated by the manufacturer to adjust the pump discharge.

The rate of discharge through the discharge pipe 3 is measured while the plug member 41 of the overflow mechanism 4 is rotated by a tool such as a screw driver to adjust the rate of overflow of pumped fuel through the overflow mechanism. If the fuel pressure at the discharge end of the discharge pipe 3 is higher than a predetermined desirable level, then the plug member 41 can be rotated to increase the overflow through the overflow mechanism 4 to lower the upper limit of fuel discharge pressure of the pump 2, and vice versa. As such, not only the lower limit of the pump discharge pressure but also the upper limit threof can be adjusted to fall within a predetermined discharge pressure range to thereby avoid any undue pressure rise in the fuel injection system due to insufficient pressue regulating ability of the pressure regulator in the fuel injection system.

Figure 12:
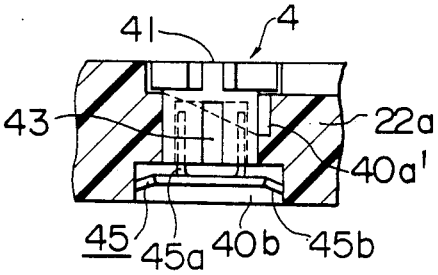
FIG. 12 is a view similar to FIG. 7 but shows the adjustment-locking member inserted into the bottom end of the plug hole and attached to the plug.
Figure 13:
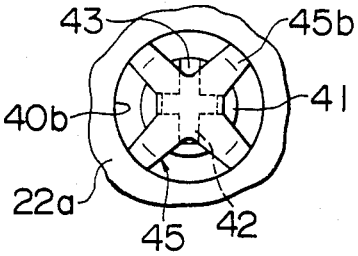
FIG. 13 is a bottom view of the overflow mechanism and the locking member shown in FIG. 12.

Referring to FIGS. 10 to 13, the fuel pump 2 is provided with means for locking the adjustment of the overflow mechanism 2 thus obtained. The locking means comprises an adjustment locking member 45 driven into the lower hole section 40*b* in the outer pump housing member 22*a* and into the tool-engagement recess 42 in the plug member 41, as shown in FIGS. 12 and 13, to prevent any further accidential or intentional rotation of the plug member 41 relative to the plug hole 40 to thereby lock the adjustment of the overflow characteristic of the overflow mechanism 4. The adjustment-locking member 45 is formed from a plastic material and has a pair of legs 45*a* engaged with the tool-engagement recess 42 in the plug member 41 and a base portion having radial arms 45*b* firmly engaged with the inner peripheral surface of the lower section 40*b* of the plug hole 40.

It will be noted that the adjustment-locking member 45 is driven into the plug hole section 40*b* and into the tool-engagement reces in the plug member 41 after all of the other component parts of the fuel pump 2 have been assembled and the rate of the overflow of the fuel through the overflow mechanism 4 has been adjusted.

What is claimed is:

1. A motor-driven fuel pump for use in a fuel tank to pump liquid fuel from the fuel tank through a pressure regulator and an injector into an internal combustion engine, said fuel pump including:

an electric motor;

a pump housing adapted to be disposed in said fuel tank and defining a pump chamber provided with a fuel inlet and a fuel outlet;

an impeller rotatably disposed in said pump chamber and drivingly connected to said electric motor to suck the fuel through said fuel inlet into said pump chamber and discharge the fuel through said fuel outlet;

means defining a fuel discharge passage in a part of said pump housing extending in fluid-flow communication with said pump chamber outlet;

a check valve disposed in said fuel discharge passage to prevent backward flow of the fuel toward said pump chamber outlet; and overflow means operative to allow a part of the fuel in said fuel discharge passage upstream of said check valve to overflow back into said fuel tank at a controlled rate, said overflow means including a plug hole formed in said part of said pump housing and connecting said fuel tank withsaid fuel discharge passage in fluid-flow communication with each other and a plug member disposed in said plug hole, said plug hole and said plug member being so shaped and dimensioned as to define therebetween an overflow passage having a fluid-flow cross-sectional area determined by the position of said plug member relative to said plug hole, wherein said plug member is snugly received in said plug hole and has an outer peripheral surface disposed in slidable but substantially liquid-tight sealing engagement with the inner peripheral surface of said plug hole, said plug member is provided with a substantially axial groove formed in the outer peripheral surface thereof and extending over a part of the axial length thereof, said plug hole is provided with a circumferential recess formed in the inner peripheral surface thereof and having an upstream end communicated with said fuel discharge passage, said circumferential recess having a bottom edge inclined to the axis of said plug member, said axial groove being overlapped with said circumferential recess, said plug member is rotatable relative to said plug hole to vary the area of overlap of said axial groove with said circumferential recess and thus the fluid-flow cross-sectional area of said overflow passage, said overflow passage fluid-flow cross-sectional area being variable from the maximum to the minimum within one complete rotation of said plug member.

2. A motor-driven fuel pump according to claim 1, wherein said pump housing extends to surround at least a part of said electric motor.

3. A motor-driven fuel pump according to claim 2, wherein said fuel discharge passage defining means includes a fuel discharge pipe extending substantially parallel to the axis of said electric motor and said check valve is disposed in said fuel discharge pipe.

4. A motor-driven fuel pump according to claim 1, wherein said plug member has an outer end face provided with a tool-engagement means.

5. A motor-driven fuel pump according to claim 4, further including means for blocking access to said tool-engagement means.

6. A motor-driven fuel pump according to claim 5, wherein said tool-engagement means comprises a tool-engagement recess shaped to be snugly engaged by a tool and said access blocking means comprises a member firmly engaged with the inner peripheral surface of said plug hole and extending into said tool-engagement recess.

7. A motor-driven fuel pump for pumping liquid fuel from a fuel tank through a pressure regulator and an injector into an automotive internal combustion engine, said fuel pump being adapted to be installed in the tank and including:

an electric motor adapted to be electrically driven by an electric power source mounted on an automobile equipped with the internal combustion engine;

a pump housing defining therein a pump chamber provided with fuel inlet and outlet both formed in said pump housing;

an impeller rotatably disposed in said pump chamber and drivingly connected to said electric motor to suck the fuel from said tank through said fuel inlet into said pump chamber and discharge the fuel through said fuel outlet;

said pump housing including a portion which defines therein a fuel discharge passage communicated at an upstream end with said fuel outlet and having a downstream end adapted to be connected to said pressure regulator;

a check valve disposed in said fuel discharge passage to prevent backward flow of the fuel toward said pump chamber fuel outlet;

an overflow means provided in said portion of said pump housing to allow a part of the fuel in said fuel discharge passage upstream of said check valve to overflow from said fuel discharge passage into said fuel tank;

said pump housing including an outer pump housing member formed therein with said fuel inlet, an inner pump housing member disposed adjacent to said electric motor and in abutment engagement with said outer pump housing member to cooperate therewith to define said pump chamber;

said electric motor including a brush unit and a commutator in sliding contact therewith;

said pump housing further including a brush housing member retaining said brush unit in position, and a york housing uniting said outer and inner pump housing members and said brush housing member together;

said overflow means including a plug hole formed in said portion of said pump housing and connecting said fuel tank with said fuel discharge passage in fluid-flow communication with each other and a plug member disposed in said plug hole;

said plug hole and said plug member being so shaped and dimensioned as to define therebetween an overflow passage having a fluid-flow cross-sectional area determined by the position of said plug member relative to said plug hole, wherein said plug member is snugly received in said plug hole and has an outer peripheral surface disposed in slidable but substantially liquid-tight sealing engagement with the inner peripheral surface of said plug hole, said plug member is provided with a substantially axial groove formed in the outer peripheral surface thereof and extending over a part of the axial length thereof, said plug hole is provided with a circumferential recess formed in the inner peripheral surface thereof and having an upstream end communicated with said fuel discharge passage, said circumferential recess having a bottom edge inclined to the axis of said plug member, said axial groove being overlapped with said circumferential recess, said plug member is rotatable relative to said plug hole to vary the area of overlap of said axial groove with said circumferential recess and thus the fluid-flow cross-sectional area of said overflow passage, said overflow passage fluid-flow cross-sectional area being variable from the maximum to the minimum within one complete rotation of said plug member.

8. A motor-driven fuel pump according to claim 7, wherein said plug hole has an outer end exposed in the outside of said pump housing and provided with a tool-engagement means for engagement by a tool to adjust the rotational position of said plug member relative to said plug hole and wherein said overflow means further includes an adjustment-blocking member for locking the adjusted rotational position of said plug member.

9. A motor-driven fuel pump for use in a fuel tank to pump liquid fuel from the fuel tank through a pressure regulator and an injector into an internal combustion engine, said fuel pump including:

an electric motor;

a pump housing adapted to be disposed in said fuel tank and comprising first and second housing members which cooperate to define therebetween a pump chamber provided with a fuel inlet and a fuel outlet;

as impeller rotatably disposed in said pump chamber and drivingly connected to said electric motor to suck the fuel through said fuel inlet into said pump chamber and discharge the fuel through said fuel outlet;

means defining a fuel discharge passage in a part of said pump housing extending in fluid-flow communication with said pump chamber outlet;

a check valve disposed in said fuel discharge passage to prevent backward flow of the fuel toward said pump chamber outlet; and overflow means operative to allow a part of the fuel in said fuel discharge passage upstream of said check valve to overflow back into said fuel tank at a controlled rate, said overflow means including a plug hole formed in one of said first and second pump housing members and communicated with said fuel discharge passage and a plug member having a stem portion disposed in said plug hole, said plug hole and said stem portion of said plug member being so shaped as to define therebetween an overflow passage having a fluid-flow cross-sectional area determined by the position of said plug member relative to said plug hole, wherein said plug member is snugly received in said plug hole and has an outer peripheral surface disposed in slidable but substantially liquid-tight sealing engagement with the inner peripheral surface of said plug hole, said plug member is provided with a substantially axial groove formed in the outer peripheral surface thereof and extending over a part of the axial length thereof, said plug hole is provided with a circumferential recess formed in the inner peripheral surface thereof and having an upstream end communicated with said fuel discharge passage, said circumferential recess having a bottom edge inclined to the axis of said plug member, said axial groove being overlapped with said circumferential recess, said plug member is rotatable relative to said plug hole to vary the area of overlap of said axial groove with said circumferential recess and thus the fluid-flow cross-sectional area of said overflow passage, said overflow passage fluid-flow cross-sectional area being variable from the maximum to the minimum within one complete rotation of said plug member;

said first and second pump housing members having faces directed toward each other and disposed adjacent to said fuel discharge passage; and said plug member further including a flange portion extending radially outwardly from one end of said stem portion, said flange portion being disposed and held between said faces of said first and second pump housing members whereby said stem portion of said plug member is retained in said plug hole against removal therefrom.

* * * * *